United States Patent [19]

Andrusiak

[11] 3,938,772

[45] Feb. 17, 1976

[54] FOLDING DISPLAY EASEL

[76] Inventor: Peter W. M. Andrusiak, 124 Regina St., New Westminster, British Columbia, Canada, V3L 1S5

[22] Filed: Nov. 25, 1974

[21] Appl. No.: 526,905

[52] U.S. Cl. ..... 248/461; 40/155

[51] Int. Cl.[2] ..... A47B 97/08

[58] Field of Search ..... 248/460, 461, 462–465, 248/441, 447, 448, 454, 455, 458, 459; 160/135, 351; 312/233, 234; 40/155, 156, 152.1, 152, 124.1, 126 A, 341, 102–104.18

[56] References Cited

UNITED STATES PATENTS

| | | | |
|---|---|---|---|
| 1,748,034 | 2/1930 | Blackman | 40/155 |
| 2,538,318 | 1/1951 | Mitchell | 248/448 |
| 2,587,698 | 3/1952 | Corn, Jr. et al. | 160/135 |
| 2,656,632 | 10/1953 | Detje | 248/460 X |
| 2,784,779 | 3/1957 | Knipfer et al. | 160/135 |
| 3,132,432 | 5/1964 | Yee | 248/460 X |

*Primary Examiner*—James T. McCall
*Assistant Examiner*—Terrell P. Lewis
*Attorney, Agent, or Firm*—Carver and Company

[57] ABSTRACT

Folding display easel for supporting documents for easy viewing. Easel has a center panel with upper and lower flanges, two inner panels slidingly engaging the flanges, and two outer panels hinged to outer edges of respective inner panels. Inner panels engage track means on flanges of center panel and are supported so that inner panels are spaced laterally from each other and from the center panel to permit the five panels to be stacked together without interference between adjacent panels. One leg hinged to rear of center panel, when extended supports the easel erected, and when folded serves also as handle. When extended outer panels are inclined obliquely to inner panels for easy viewing. Latch means holds panels together for carrying.

10 Claims, 10 Drawing Figures

FOLDING DISPLAY EASEL

BACKGROUND OF THE INVENTION

1. Field of the Invention

The invention relates to a folding display easel for supporting documents for easy viewing, particularly for use when it is necessary to refer to several documents essentially simultaneously.

2. Prior Art

Folding display easels are known and are commonly used by salesmen and lecturers for displaying items as visual aids, or by persons who require a relatively large area for displaying documents for ready reference. Commonly, such easels are characterized by a plurality of panels hinged together at adjacent edges and supported by a plurality of folding legs. Commonly one leg extends from each panel and assembling and disassembling such easels is time consuming and generally inconvenient. Often, when the easel is extended the panels are coplanar, which introduces difficulties for viewing as many such displays extend over distances of several feet.

SUMMARY OF THE INVENTION

The invention reduces difficulties of the prior art by providing a folding display easel having five panels to provide a large display area, but requires only one support leg and thus can be assembled and disassembled quickly and conveniently. When erected outer panels are inclined obliquely to inner panels for easy viewing. Some panels of the easel can also slide relative to each other for folding the device for storage or carrying, and when folded the support leg also serves as a handle.

The folding easel according to the invention has a center panel, right-hand and left-hand inner and outer panels and a leg. The center panel has spaced parallel upper and lower edges and spaced side edges, the upper and lower edges having track means adjacent thereto. The leg is hinged to the center panel and is adapted to extend therefrom. The leg is restricted against swinging relative to the center panel to support the center panel generally upright when the easel is erected and stood on a generally horizontal working surface. The right-hand and left-hand inner panels engage the respective track means of the center panel for sliding of the inner panels relative to the center panel. The inner panels are spaced laterally from each other and from the center panel to permit sliding together of the panels for stacking. The inner panels also have respective inner and outer edges and respective parallel upper and lower edges. The right-hand and left-hand outer panels have respective inner and outer edges, the inner edges of the left-hand and right-hand outer panels being hinged to the outer edges of the left-hand and right-hand inner panels respectively. Each outer panel is adapted to be folded essentially flat against a respective inner panel and when so folded to be spaced laterally from the adjacent inner panel and the center panel. Thus when each outer panel is folded against its respective inner panel, the inner panels can be slid together along the track means without interference between adjacent panels so that the five panels are stacked together.

A detailed disclosure following, related to drawings, describes a preferred embodiment of the invention, which however is capable of expression in structure other than that particularly described and illustrated.

DETAILED DISCLOSURE

FIG. 1

Figure 1:
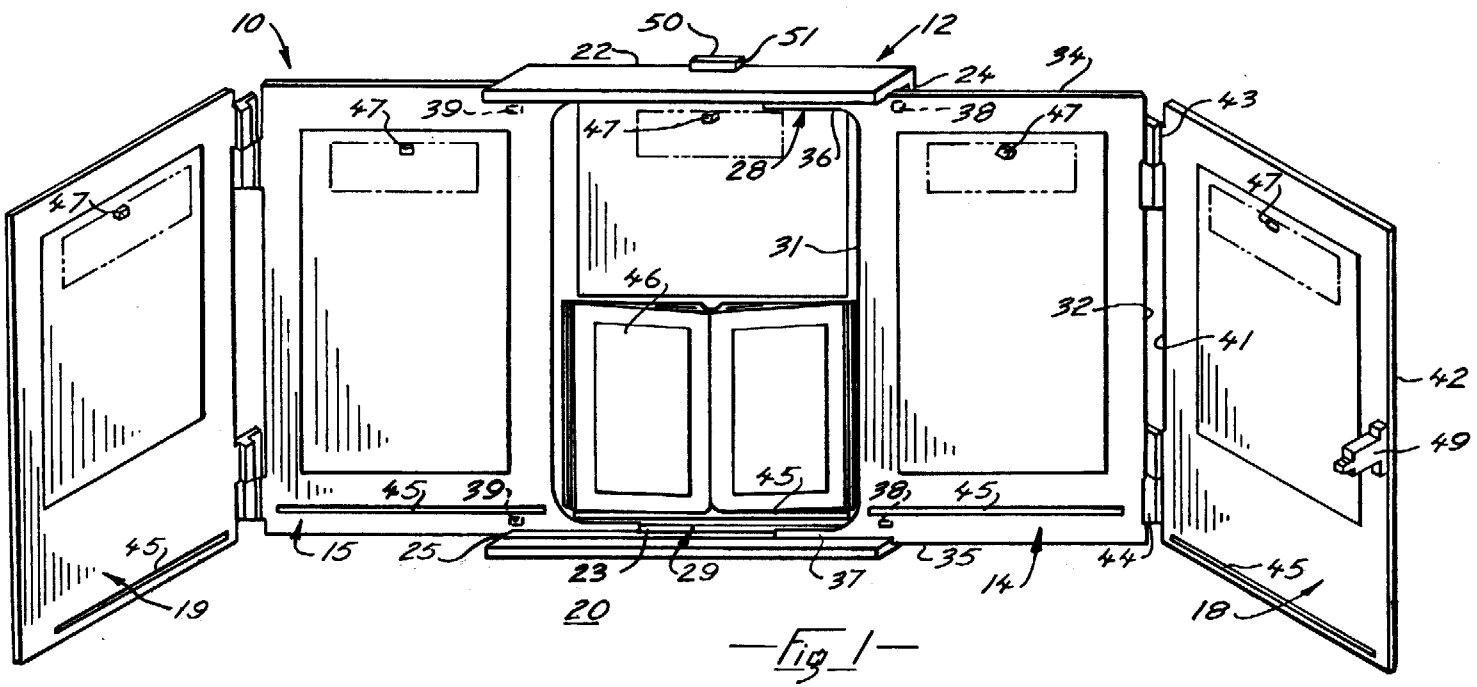
FIG. 1 is a simplified isometric view of a folding display easel according to the invention, the easel being shown erected on a horizontal working surface.

A folding display easel 10 according to the invention has a center panel 12, right-hand and left-hand inner panels 14 and 15, and right-hand and left-hand outer panels 18 and 19. The easel is shown erected on a generally horizontal working surface 20 and is supported thereon by a leg, not shown, to be described with reference to FIGS. 2 and 3.

The center panel 12 has spaced parallel upper and lower edges 22 and 23 and spaced parallel right-hand and left-hand side edges 24 and 25 respectively, end portions only of the side edges being shown. The upper and lower edges 22 and 23 have upper and lower flanges 28 and 29 extending forwardly therefrom so as to have oppositely disposed parallel inner faces. The right-hand inner panel 14 has parallel inner and outer edges 31 and 32, and parallel upper and lower edges 34 and 35 respectively. A pair of spaced parallel extensions 36 and 37 extend inwards from the inner edge 31 and are aligned with the upper and lower edges respectively of the inner panel and are coplanar therewith. The left-hand inner panel 15 has similar edges and extensions and is essentially a mirror image of the right-hand panel. As will be described with reference to FIGS. 8 and 9, the extensions and upper and lower edges of the inner panels are adapted to engage parallel track means provided on respective inner faces of the flanges, to permit lateral sliding of the inner panels relative to each other and to the center panel with negligible rocking of the panels. Stops 38 and 39, shown in broken outline, are provided on rear faces of the inner panels 14 and 15 respectively and serve to limit outwards movement of the inner panels relative to the centre panel by engaging end stops at ends of the track means, to be described with reference to FIGS. 8 and 9.

The right-hand outer panel 18 has spaced parallel inner and outer edges 41 and 42, the inner edge 41 being hinged to the outer edge 32 of the right-hand inner panel by hinge means 43 and 44, as will be described with reference to FIGS. 4 and 5. The left-hand outer panel 19 has similar edges and is similarly hinged at the inner edge thereof to the outer edge of the inner panel 15.

Figure 6:
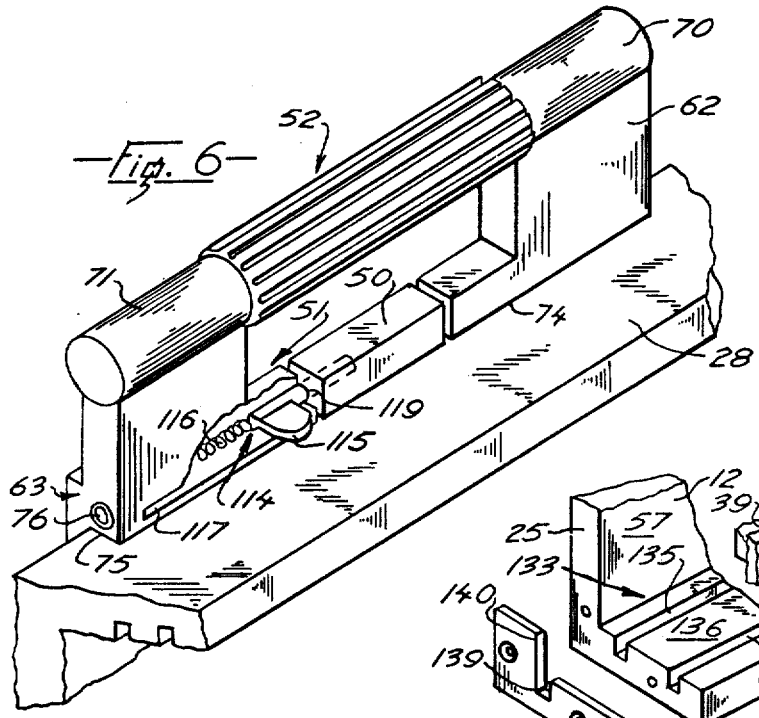
FIG. 6 is a fragmented perspective of a handle adjacent an upper edge of a center panel of the invention.

Support means, severally 45, are provided adjacent the lower edges of each of the five panels to support documents thereagainst, such as books. Each support means is suitably a flat strip of sufficient thickness and length to retain a book thereon when the panel is inclined at approximately 45° to the horizontal, as shown in FIG. 3. The panels can be made of a magnetic material, such as sheet steel, and small magnets, severally 47, can be used to retain pieces of paper against the panel. Alternatively thin metal plates can be bonded to panels of plastic or wood to serve a similar purpose. A portion of a latch means 49 is provided on the outer edge 42 of the right-hand panel 18 and can engage a complementary portion (not shown) on the center panel 12, to be described with reference to FIG. 7. A projection 50 adjacent the upper edge 22 of the panel 12 forms a portion of a handle latch means 51 to be described with reference to FIG. 6.

Figures 2, 3, 4, 5:
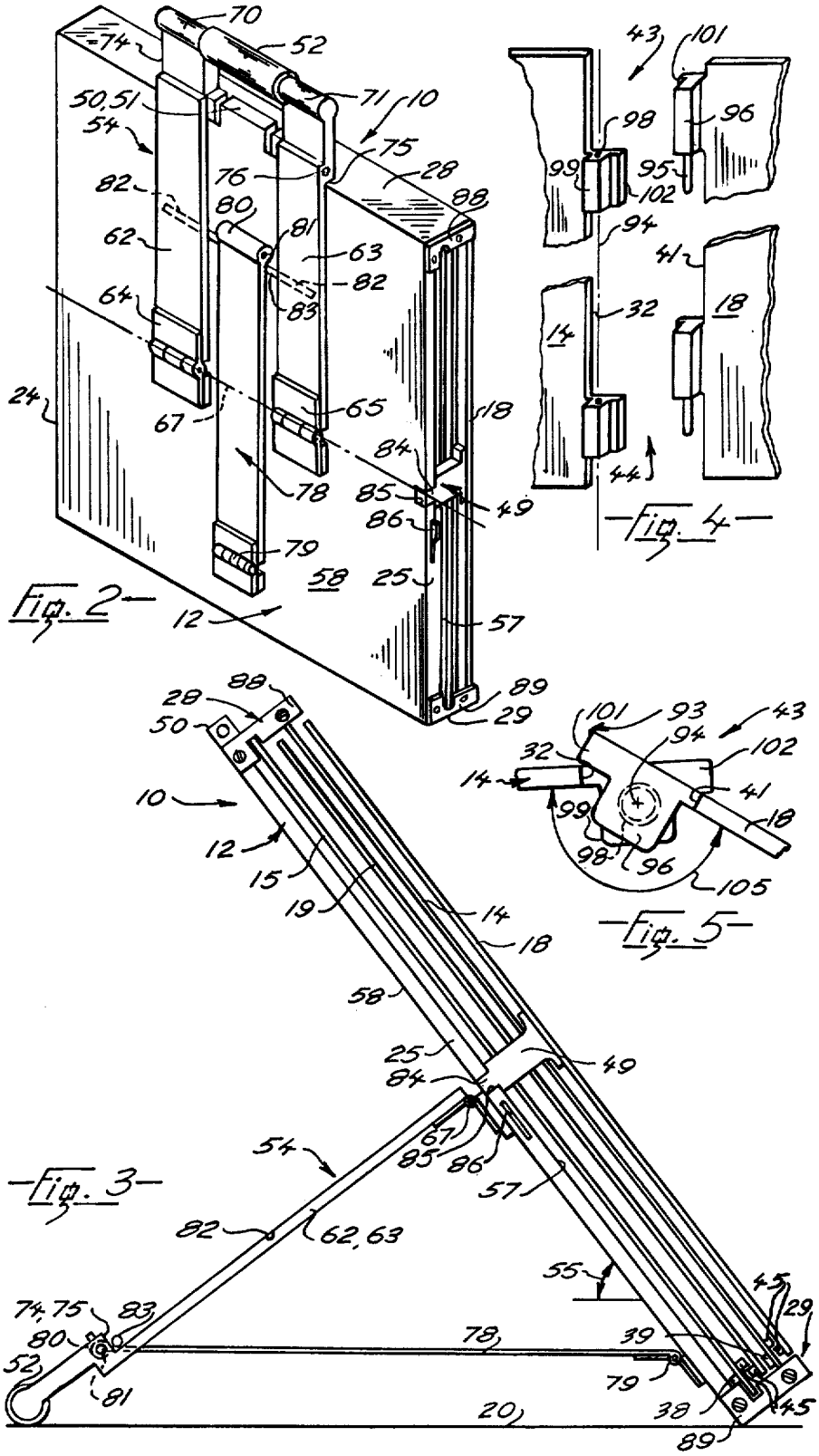
FIG. 2 is an isometric of the easel folded.
FIG. 3 is a side elevation of the easel prior to erecting the easel, a leg being shown extended to support the easel.
FIG. 4 is a fragmented perspective of a hinge means adjacent edges of two panels.
FIG. 5 is a fragmented top plan view of a portion of the hinge means of FIG. 4.

FIGS. 2 and 3

In FIG. 2 the easel 10 is shown folded for carrying by a handle 52 adjacent the upper flange 28. The handle 52 is a portion of a leg 54, which also serves to support the easel generally upright when the easel is erected as shown in FIG. 1, or prior to erection as shown in FIG. 3.

Referring to FIG. 3, the leg 54 is hinged to the center panel 12 and extends therefrom to a supporting position to support the center panel generally upright when the easel is stood on the generally horizontal surface 20. The term "generally upright" refers to an angle of inclination 55 of the center panel relative to the surface 20 of about 45°. The angle could range between approximately 70° and 40° depending on desired angle for viewing exhibits or documents on the panels.

In FIG. 2, the panels are stacked together and the latch means 49 holds the panel 18 to the center panel 12 for carrying and storage. The center panel 12 has front and rear faces 57 and 58, the flanges 28 and 29 extending forwardly from the front face 57, best seen in FIG. 3. The leg 54 has a pair of spaced leg members 62 and 63 hinged at inner ends 64 and 65 thereof to the rear face 58 for swinging about a common hinge axis 67. The leg members have outer ends 70 and 71 respectively aligned with the handle 52, and shoulders 74 and 75 respectively adjacent the outer ends thereof. The handle 52 contacts the working surface 20 when the easel is erected and is a connecting member extending between the outer ends of the spaced leg members parallel to the common hinge axis and serves as a handle when the device is folded and is to be carried.

The shoulders 74 and 75 offset the handle 52 forwardly relative to the hinge axis so that the handle is positioned over the center of the easel when folded, thus causing the easel to hang essentially vertically when carried by the handle. The shoulders are positioned so as to be aligned with the projection 50, for engagement of a complementary latch portion with the handle latch means 51 to hold the handle raised. A portion of the leg member 63 adjacent the shoulder 75 thereof has a passage 76 which forms a portion of the handle latch means 51, as will be described with reference to FIG. 6. Note that the handle is spaced from the hinge a distance greater than the hinge is spaced from the upper edge of the center panel so that in the raised position the handle is spaced upwards from the upper edge of the center panel.

A strap 78 has an inner end 79 hinged to the rear face 58 of the center panel 12, and an outer end 80 provided with a boss having a passage 81 extending transversely therethrough. The outer end of the strap also has a pin 83 extending transversely therefrom and disposed parallel to the common hinge axis 67. The pin is positioned on the strap so that, with the leg in the supporting position and the pin resting on the shoulders 74 and 75, the passage 76 of the latch means 51 and the passage 81 of the boss are aligned. The passage 81 is a portion of the handle latch means 51, the pin 83 thus facilitating engagement of the latch means 51 with the passage 81. Thus the outer end of the strap 78 is held adjacent the shoulders 74 and 75 by the handle latch means. In this position, the latch means 51 thus locates the strap relative to the leg means to restrict the leg members from swinging relative to the center panel.

When the leg is swung upwards to the raised position as shown in FIG. 2, the latch means 51 is released and the pin is relocated in a complementary aligned pin recess 82 on the leg members 62 and 63 so as to be held between the leg members and the rear face 58 of the center panel. Thus when the leg 54 is retracted and swung into the raised position, the strap 78 is automatically simultaneously raised and located against the center panel.

Thus the strap 78 is a tie means to cooperate with the leg and the center panel to limit outwards swinging of the leg when the leg is to support the easel erected, and to permit the leg to swing upwards to the fully raised position when the easel is to be folded and carried.

When the device is folded, a tongue 84 of the latch means 49 extends past the adjacent end edges of the inner and outer panels and engages a complementary recess 85 on the left-hand side edge 25 of the inner panel. As will be described with reference to FIG. 7, the edge 25 has a tab 86 extending therefrom for manually engaging and disengaging the latch means 49.

Figure 8:
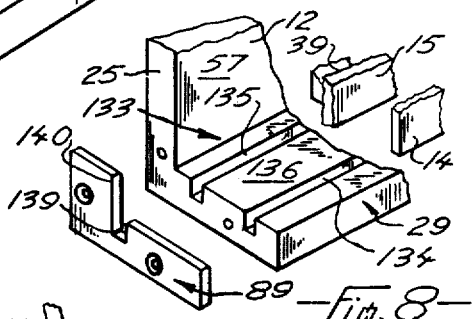
FIGS. 8 and 9 are exploded fragmented perspectives showing stop means adjacent ends of track means of the invention.
Figure 10:
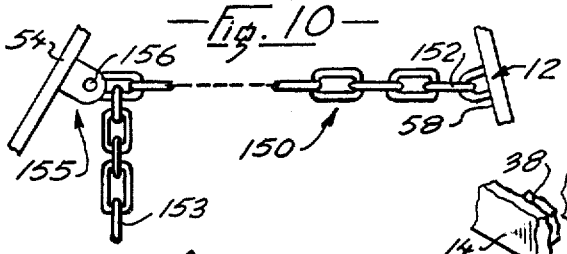
FIG. 10 is a fragmented elevation of a portion of an alternative strap.
Figure 9:
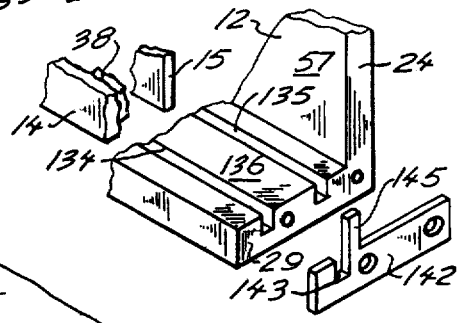

End stops 88 and 89 are fitted at opposed upper and lower edges of the center panel 12 and, as will be described with reference to FIG. 8, prevent the panels sliding off the track means. Other end stops, shown only in FIG. 9, are fitted at opposite ends of the track means adjacent the right-hand side edge 24 of the center panel.

FIGS. 4 and 5

Referring to FIG. 4, the hinge means 43 and 44 are essentially similar and provide a simple means of releaseably hinging the panels 14 and 18 together for rotation about a hinge axis 94, and also provide hinge stop means 93 to limit swinging between the panels. The outer panel can also be easily separated from the inner panel by lifting the outer panel along the axis 94.

The hinge means 43 includes a downwardly extending hinge pin 95 extending from a lug 96 secured to the edge 41 of the outer panel 18, the pin being accepted in a complementary opening 98 in a similar lug 99 secured to the adjacent edge 32 of the inner panel 14. The pin and opening are concentric with the axis 94 and form a simple releaseable hinge means, weight of the outer panel holding the hinge portions in engagement. As best seen in FIG. 5, the lugs 96 and 99 have extending projections 101 and 102 respectively, the projections extending sufficiently so as to engage edges 32 and 41 of the panels 14 and 18 respectively when the panels are inclined to each other at an angle 105, about 150 degrees. When the projections engage the edges, further outwards swinging of the panels is prevented and thus the projections and edges serve as the hinge stop means 93 cooperating with respective inner and outer panels to limit the swinging of the outer panel relative to the respective inner panel and to support the outer panels at a desired angle for convenient viewing. Clearly, in theory, only one projection is needed and the second projection is redundant. Similarly the hinge means 44 at a lower end of the panel has two further projections which are also redundant. However, due to flexibility of the panels, at least one stop means is provided, thus reducing loading on the hinge portions.

FIG. 6

When the easel is folded for carrying, the handle 52 is positioned adjacent the upper flange 28 and held thereagainst by the handle latch means 51. The passage 76 of the leg member 63 carries a spring-loaded plunger 114 having a tab 115 extending therefrom and passing through a slot 117 in the leg 63 communicating with the passage 76. A spring 116 forces the plunger outward of the leg member 63 to engage the latch means and the tab serves as a means to move the plunger manually for disengaging the latch means. The tab 115 also serves as a stop means for limiting sliding of the plunger along the passage 76 by interference of the tab 115 with ends of the slot.

The projection 50 has a bore 119 which is aligned with the passage 76 when the handle is in the raised position as shown, so as to accept an outer end of the plunger 114 urged therein by the spring 116. Thus the plunger 114 and bore 119 are engaging portions of the handle latch means 51 cooperating with the leg and the center panel to engage the leg in the raised position to hold the leg adjacent the rear face of the center panel.

Thus, as previously described with reference to FIG. 3, when the leg 54 is extended, the plunger of the latch means 51 engages the passage 81 at the end of the strap 78. Thus the latch means 51 is used to retain the leg in both the raised and supporting position of the leg 54, thus serving two important functions.

FIG. 7

Figure 7:
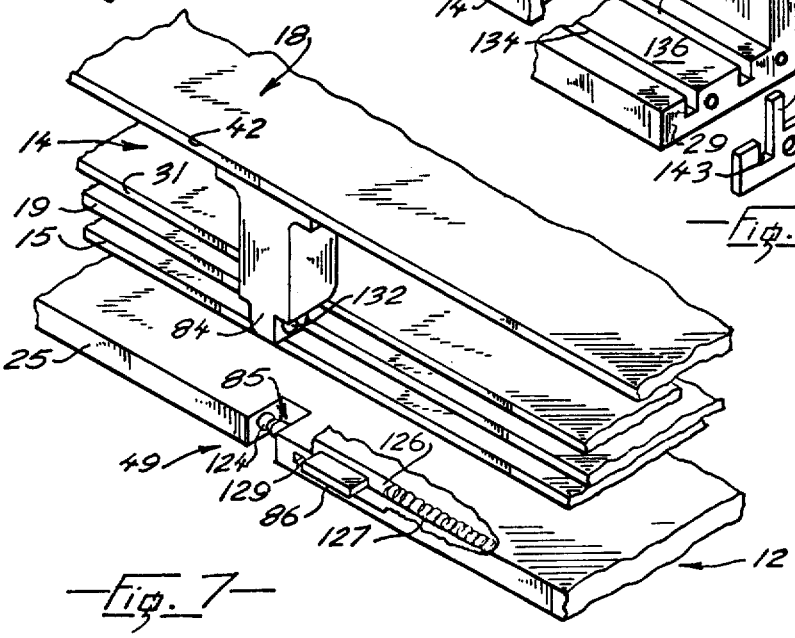
FIG. 7 is a fragmented perspective of latch means associated with edges of the panels.

As previously described with reference to FIGS. 1 and 3, the right-hand inner and outer panels 14 and 18 are spaced forwardly of the left-hand inner and outer panels 15 and 19 respectively. Thus, when the easel is partially folded as shown in FIG. 7, the right-hand panel is on the outside of the stack of panels. The tongue 84 of the latch means 49 is adjacent the outer edge 42 and the recess 85 provided on the edge 25 accepts an outer end of the tongue 84. The center panel has a passage 124 extending adjacent to and parallel with the edge 25 of the panel and across the recess 85. A plunger 126 is slideable along the passage 124 and is urged across the recess 85 by a spring 127. A longitudinal slot 129 communicating with the passage 124 extends along the edge 25 and the tab 86 extends through the slot for manually moving the plunger along the passage 124 for disengagement of the plunger, similarly to the plunger 114 of the latch means 51 of FIG. 6. The tongue 84 has a bore 132 which, when the tongue engages the recess 85, is aligned with the passage 124. Thus when the plunger 126 is extended it engages the bore 132 and retains the panels together. Thus the recess 85 and spring-loaded plunger 126 serve as portions of the latch means 49 provided at the left-hand edge of the center panel, and hold the panels stacked together when the easel is folded.

FIG. 8

As stated with reference to FIG. 1, the lower flange 29 has track means 133 to accept the inner panels 14 and 15, the track means being spaced forwardly from the front face 57 of the panel 12. The track means includes a pair of spaced parallel grooves 134 and 135 provided in an upper or inner face 136 of the flange 29. The grooves 134 and 135 have sufficient width to accept the lower edges of the inner panels 14 and 15 respectively which can thus slide freely along the grooves. The right-hand inner panel 14 is prevented from passing the left-hand edge 25 of the flange by interfering with the end stop 89, which seals off the end of the groove 134. The end stop 89 has a clearance groove 139 which is aligned with the groove 134 to permit the left-hand inner panel to slide beyond the end stop. The stop 39 on the rear face of the panel 15 interferes with a projection 140 extending above the surface 136 of the flange when the panel 15 is fully extended from the center panel. This prevents removal of the panel 15 from the center panel unless screws (not shown) securing the end stop to the flange are removed. The end stop 88 (FIG. 1 only) is basically similar to the end stop 89 and cooperates with the left-hand end of the upper flange 28. Thus both upper and lower edges of the panels are limited against excessive outwards movement and both inner panels are prevented from leaving the left-hand end of the flanges.

FIG. 9

The lower flange 29 has a right-hand end adjacent the edge 24 of the panel, the right-hand end being provided with an end stop 142 which closes off the end of the groove 135, to prevent the panel 15 leaving the groove. The stop 142 has a clearance groove 143 aligned with the groove 134 for passing the panel 14. A projection 145 extends upwards from the end stop 142 above the inner surface 136 and interferes with the stop 38 on the rear face of the panel 14 when the panel 14 is fully extended. The stop 38 thus limits extension of the panel 14 similarly to the stop 39 on the panel 15. A further end stop (not shown) is provided at the right-hand end of the upper flange and is similar to the end stop 142 to prevent the panels leaving the right-hand end of the flanges. Thus both inner panels have stop means cooperating with the track means to limit outwards sliding of the inner panels relative to the centre panel.

OPERATION

The device is normally carried folded as shown in FIG. 2, and thus can be lifted easily and placed so that the lower flange 29 rests on the working surface 20. The stack of panels is held in one hand, whilst the latch means 51 is released permitting the handle 52 and the leg 54 to swing downward so that the handle 52 contacts the working surface as the stack of panels is inclined backwards as in FIG. 3. Simultaneously with the release of the leg members 62 and 63, the outer end 80 of the strap 78 swings outwards and downwards towards the latch means 51 at the outer end of the leg 54. The plunger 114 is engaged easily in the passage 81 at the outer end 80 of the strap 78 which is held in register with the passage 76 by the pin 83. The stacked panels and the leg and strap are then positioned as shown in FIG. 3, with the leg in the supporting position.

The latch means 49 is released from the center panel 12 so that the right-hand outer panel 18 can hinge about the inner panel 14 as the inner panel is simultaneously slid outwards along the flanges until the stop 38 engages the projection 145 on the end stop 142, (FIG. 9). The outer panel 18 hinges about the hinge axis 94 until the projections 101 and 102 (FIG. 5) engage edges of the panels to limit swinging of the outer panel. The left-hand inner and outer panels can now be slid leftwards along the groove 135 until the stop 39 engages the projection 140 extending from the end stop 89 (FIG. 8). The left-hand outer panel can then be swung outwards about the hinge connecting the inner and outer left-hand panels. Books or other documents or exhibits can be supported on the support means. The reverse procedure is followed for folding the device.

ALTERNATIVES AND EQUIVALENTS

FIG. 10

An alternative tie means is a flexible chain 150 made of a plurality of interconnected links, the chain being substituted for the strap 78 of FIG. 3. The chain has an inner end 152 secured adjacent the lower edge of the rear face 58 of the panel 12, and an outer end 153 hanging freely as shown from the leg 54. A releasable chain attachment means 155 is provided adjacent the outer end of the leg 54 and has a pin 156 adapted to pass through a link to releaseably secure the chain to the attachment means. The particular link through which the pin 156 is threaded is selected so that the leg is held in the supporting position at an angle for supporting the device when erected at a suitable angle for viewing. By selecting different links for attachment, a wide range of angles of inclination of the panels can be attained. When the device is to be folded, the chain 150 is released from the means 155 and the leg is folded upwards to the fully raised position, as in FIG. 2, and the end 153 is connected to the attachment means 155 for convenience. Thus the chain 150 has sufficient length to extend to the attachment means when the leg is in the fully raised position, the chain not being shown in this position.

I claim:

1. A folding display easel for supporting documents for easy viewing, the easel having:

a. a center panel having a front face and spaced, parallel upper and lower edges and spaced side edges, the upper and lower edges having parallel track means spaced forwardly of said front face, b. a leg hinged to the center panel and adapted to extend therefrom, the leg being restricted against swinging relative to the center panel to support the center panel generally upright when the easel is erected and stood on a generally horizontal working surface, c. right-hand and left-hand inner panels engaging the respective parallel track means of the center panel for sliding of the inner panels relative to the center panel, the inner panels being spaced laterally from each other and forwardly from the center panel to permit sliding together of the panels for stacking, each inner panel having respective inner and outer edges and respective parallel upper and lower edges, d. right-hand and left-hand outer panels having respective inner and outer edges, the inner edges of the left-hand and right-hand outer panels being hinged to the outer edges of the left-hand and right-hand inner panels respectively, each outer panel being adapted to be folded essentially flat against the respective inner panel and when so folded to be spaced laterally from the adjacent inner panel and the center panel, so that when each outer panel is folded against its respective inner panel, the inner panels can be slid together along the track means without interference between adjacent panels so that the five panels are stacked together.

2. A folding display easel as claimed in claim 1 further including:

i. hinge stop means cooperating with respective inner and outer panels to limit the swinging of the outer panels relative to the respective inner panels and to support the outer panels at a desired angle for convenient viewing.

3. A folding display easel as claimed in claim 1 further including:

i. support means on each panel to hold documents against the panel for convenient viewing.

4. A folding display easel as claimed in claim 1 in which the track means have stops at ends thereof and each inner panel has:

i. a pair of spaced parallel extensions extending from the inner edge of the inner panel and aligned with the upper and lower edges of the inner panel, the extensions being adapted to engage the track means to permit outward sliding of the inner panel relative to the center panel with negligible rocking of the inner panel relative to the center panel, ii. stop means cooperating with the stops of the track means to limit outwards sliding of the inner panel relative to the centre panel.

5. A folding display easel as claimed in claim 1 in which:

i. the center panel has a rear face ii. the leg has an inner end hinged to the rear face of the center panel, and has an outer end having a handle adapted to contact the working surface when the easel is erected, the handle being spaced from the hinge a distance greater than the hinge is spaced from the upper edge of the center panel so that when the leg swings to a raised position the handle is spaced upwards from the upper edge of the center panel for carrying, iii. a tie means cooperates with the leg and the center panel to limit outwards swinging of the leg when the leg is to support the easel erected, and to permit the leg to swing upwards to the fully raised position when the easel is to be folded and carried.

6. A folding display easel as claimed in claim 5 further including:

i. latch means cooperating with the leg and the center panel to engage the leg when in the raised position to hold the leg adjacent the rear face of the center panel.

7. A folding display easel as claimed in claim 5 in which:

i. the leg has a pair of spaced leg members hinged at inner ends thereof to the rear face of the center panel for swinging about a common hinge axis of the hinges, one of the leg members adjacent the outer end thereof having a latch means, ii. a connecting member extends between the outer ends of the spaced leg members parallel to the common hinge axis, the member serving as a handle when the device is to be folded and carried, iii. the tie means is a strap having an inner end hinged to the rear face of the center panel and an outer end having a pin extending transversely therefrom and disposed parallel to the common hinge axis, the pin being adapted to be retained between the leg members and the center panel when the leg is in the raised position, the outer end of the strap also having a complementary latch means to be engaged by the latch means of the leg member when the leg member and the strap are extended to a supporting position thus preventing the leg members from swinging about the center panel, iv. the center panel has a complementary latch means to be engaged by the latch means of the leg member when the leg members are folded against the center panel.

8. A folding display easel as claimed in claim 5 further including:

i. a releaseable chain attachment means provided adjacent an outer end of the leg, and in which the tie means includes:

ii. a flexible chain of interconnected links attached to the center panel, a link of the chain being releaseably attached to the chain attachment means to hold the leg at an angle for supporting the device when erected, and when the leg is released from the chain to swing upwards to the fully raised position, the chain having sufficient length to extend to the attachment means for re-attachment thereto.

9. A folding display easel as claimed in claim 1 in which:

i. the center panel has a pair of spaced parallel flanges extending forwardly from the upper and lower edges of the panel, the flanges having oppositely disposed parallel inner faces, ii. the track means includes a pair of spaced parallel grooves provided in each inner face of the flanges of the center panel, the grooves being of sufficient width and spaced apart to accept the upper and lower edges of respective inner panels with the outer panels folded thereagainst, lateral spacing between adjacent panels being such that there is negligible interference between the panels when folded and stacked together.

10. A folding display easel as claimed in claim 1 in which:

i. the right-hand inner and outer panels are spaced forwardly of the left-hand inner and outer panels so that when the easel is folded the right-hand outer panel is on the outside, ii. a panel latch means portion is provided on the outer edge of the right-hand outer panel, iii. a complementary panel latch means portion is provided at the left-hand edge of the center panel, the latch means being adapted to hold the panels stacked together when the easel is folded.

* * * * *